United States Patent [19]

Goff

[11] Patent Number: 5,022,174

[45] Date of Patent: Jun. 11, 1991

[54] RAILROAD CAR IDENTIFICATION PLATE HOLDER

[76] Inventor: Todd A. Goff, 7030 Lario Dr., Topeka, Kans. 66618

[21] Appl. No.: 435,981

[22] Filed: Nov. 13, 1989

[51] Int. Cl.[5] ..... G09F 3/20

[52] U.S. Cl. ..... 40/649; 40/642

[58] Field of Search ..... 40/649, 642, 643, 209, 40/588, 591, 611; 248/201

[56] References Cited

U.S. PATENT DOCUMENTS

| | | | |
|---|---|---|---|
| 832,338 | 10/1906 | Northup | 40/642 |
| 865,886 | 9/1907 | Guinn | 40/649 |
| 1,153,278 | 9/1915 | Ward et al. | 40/209 |
| 1,260,156 | 3/1918 | Foreest | 40/209 |
| 1,430,980 | 10/1922 | Gideon | 40/611 |
| 1,583,626 | 5/1926 | Swarts | 40/643 |
| 2,592,289 | 4/1952 | Joyner | 40/588 |
| 2,827,721 | 3/1958 | Davidson | 40/642 |
| 4,736,539 | 4/1988 | Dickinson | 40/209 |

FOREIGN PATENT DOCUMENTS

| | | | |
|---|---|---|---|
| 2556117 | 6/1985 | France | 40/649 |

*Primary Examiner*—James R. Brittain
*Assistant Examiner*—Brian K. Green

[57] ABSTRACT

This invention addresses securing and protecting encoded identification tags to movable enclosures. More specifically, this invention utilizes a base frame member in cooperation with a top frame member to secure the encoded identification tag in upward, downward, outward and side-to-side directions. While securing the encoded identication tag, this invention accommodates scanning of the tag from the top, bottom and front sides and allows safe removal and replacement of encoded identification tags.

5 Claims, 1 Drawing Sheet

RAILROAD CAR IDENTIFICATION PLATE HOLDER

FIELD OF THE INVENTION

This invention relates generally to computer scanning, encoding and decoding, and more particularly to securing and protecting encoded identification tags to movable enclosures.

BACKGROUND OF THE INVENTION AND PRIOR ART

The use of scanning devices and computers ha helped the speed and accuracy of inventory in many areas: including grocery stores, warehouses, and other industries which have high product turnover. The railroad industry has also utilized such technology. Modern scanning technology allows a rail yard to determine the contents of a railroad car without stopping the car or opening its doors. The appropriate cargo information is contained within an encoded identification tag. Said encoded identification tag is secured to a rail car and a scanning device reads this stored information when the tag passes said device.

Securing the tags to rail cars is a problem throughout the industry. Presently, such identification tags are simply being glued to the car by high strength adhesive. This technique, while crudely addressing the problem, fails to provide a fail-safe or versatile solution. With the heavy equipment located in rail yards and close clearances that are frequently encountered, a tag which is glued in place has a good possibility of becoming dislodged if a heavy object hits it. To change tags, personnel presently are required to remove the tag with a crowbar, which can easily result in damage to the tag. Another adverse side effect of the prior attachment techniques is vandalism. With only glue covering the tags, they are easily vandalized or stolen. The prior art has also failed to account for the thermo-sensitivity of many glues and adhesives. Thermal expansion and contraction in extreme heat or cold can seriously affect the adhesive qualities of many such glues which can fail without external forces being used.

SUMMARY AND OBJECTS OF THE INVENTION

The present invention provides for an improved way of securing and protecting encoded identification tags to movable enclosures.

An important object of my invention is to protect the tags from being accidentally dislodged by providing fail-safe restraints in upward, downward, and side-to-side directions.

One of the further objectives of the invention is to allow removal and changing of the tags without any threat of doing damage to the tag itself.

Another aim of the invention is to provide a tag holder which is tamper resistant as well as a deterrent to vandalism.

A further object of the invention is to provide an alternative to using glue or other adhesives for securing the tag to the movable enclosure thus avoiding the inherent failure problems associated with even the best adhesives.

Other objects of the invention will be made clear or become apparent from the following description and claims.

DESCRIPTION OF THE DRAWINGS AND PREFERRED EMBODIMENT

In the accompanying drawings which form a part of the specification and are to be read in conjunction therewith, and in which like reference numerals are used to indicate like parts in the various views.

Figure 2:
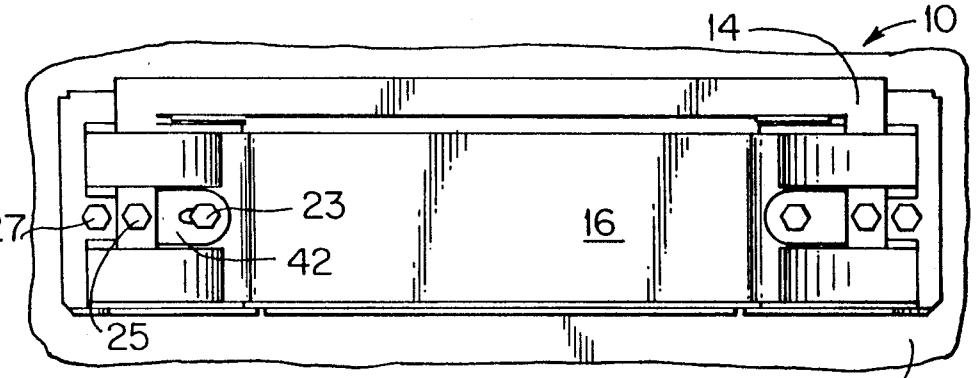
FIG. 2 is a front elevational view of the tag mounting framework of the invention as it would appear holding a tag to the side of an object.

This device can accommodate a variety of movable enclosures. This description uses a railroad car as an illustration, not as a limitation.

Referring now to the drawings in more detail, numeral 10 generally designates an assembled tag mounting device secured to a railroad car 60. The device 10 has a base frame member 12 and a top frame member 14 for holding an encoded identification tag 16.

Figure 3:
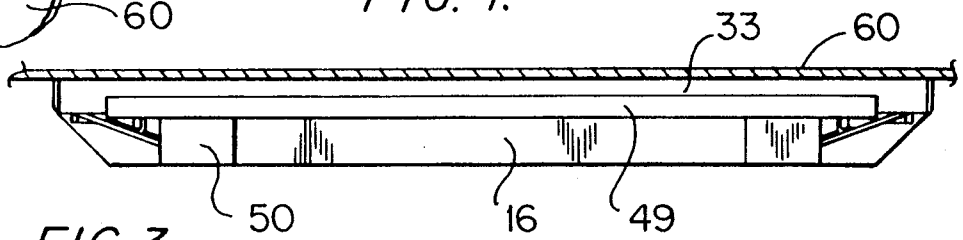
FIG. 3 is a top plan view of the device shown in FIGS. 1 and 2.
Figure 1:
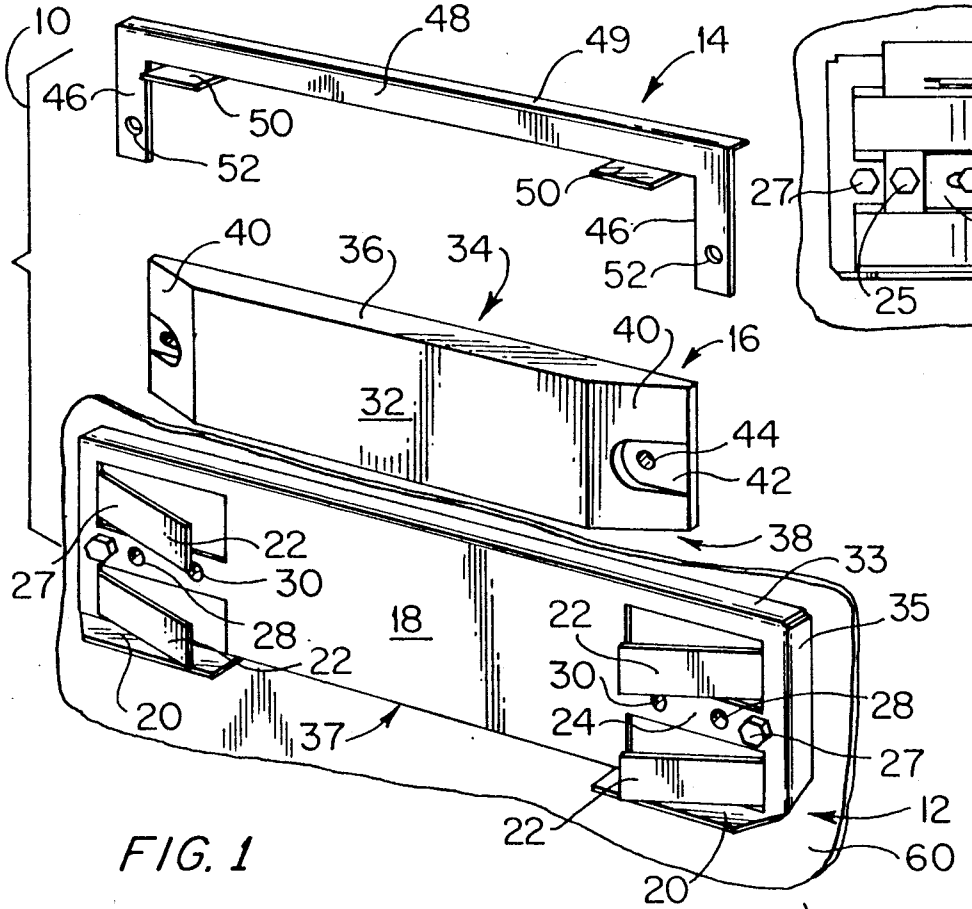
FIG. 1 is an exploded perspective view demonstrating the relationship between the encoded identification tag and the tag mounting framework of the present invention.

The base frame member 12 has a main planar section 18 generally rectangular in shape with the longer sides running horizontally. Member 12 has a planar bottom comprising two spaced apart planar sections 20 which extend outwardly from main planar section 18 at approximately 90 degrees. The open space between planar sections 20 accommodates scanning of tag 16 from below. Planar sections 20 restrain tag 16 in the downward direction. Integral with the main planar section 18 are four angular strips 22 for restraining tag 16 in outward and side-to-side directions. The four angular strips are divided into two pairs, two strips at each horizontal end of the main planar section. As best shown in FIG. 3, the strips extend outwardly from section 18 at an angle of 20 to 45 degrees (preferably about 30 degrees) to form wedge-shaped ends with the main planar section 18.

Figure 4:
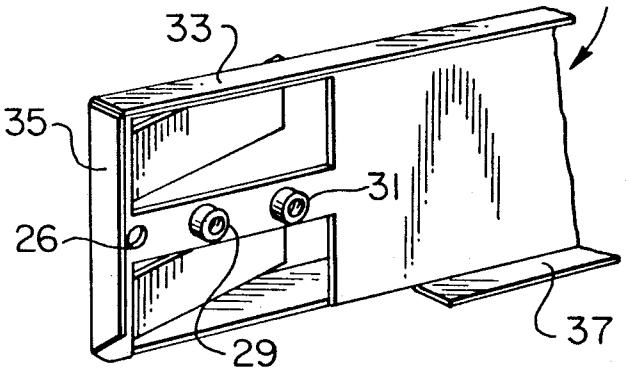
FIG. 4 is an angled perspective showing one side and part of the top and rear of the invention.

Main planar section 18 includes bars 24, one on each horizontal end of planar section 18. The bars are integral with and separate the pair of angular strips 22 positioned at each horizontal end of main planar section 18. Three horizontally spaced holes 26 (shown in FIG. 4), 28 and 30, are drilled through each of the bars 24. In the preferred embodiment the outermost holes 26 are used to secure the base frame member 12 to railroad car 60. The preferred embodiment utilizes a threaded member 27 and screws base frame member 18 to railroad car 60. This is not intended to be a limitation. The movable enclosure could be constructed with threaded members attached to it and spaced appropriately to accept the holes 26. Other variations such as welding base frame member 12 to the railroad car are also possible and intended to be included as part of this disclosure.

The middle holes 28 are used to secure the top frame member 14 with the base frame member 12. Two nuts 29 are welded behind each hole 28 to accept a threaded member 25. Threaded members 25 in cooperation with holes 28 allow the top frame and/or base frame to be secured to the railroad car. The innermost holes 30 are used to secure tag 16 to base frame 12. Two nuts 31 are welded behind each hole 30 to accept a threaded member 23. Threaded members 23 in cooperation with holes 30 allow the tag and/or base frame to be secured to the railroad car.

Main planar section 18 has a planar top 33 and two planar sides 35. Planar top 33 and planar sides 35 extend rearwardly from main planar section 18 at approximately 90 degrees. A planar bottom 37 extends rearwardly from main planar section 18 at approximately 90 degrees. Planar bottom 37 extends in the horizontal plane between the two planar bottoms 20. As an alternative embodiment, device 10 can be welded to railroad car 60 using as welding mounts planar top 33, planar sides 35 and planar bottom 37.

The encoded identification tag 16 (not part of this invention) is generally polygonal. It has a planar front surface 32, a planar back surface 34, a planar top surface 36 and a planar bottom surface 38. Said tags have planar sides 40 which extend at an acute angle from back to front, said acute angle being approximately 20 to 45 degrees, (preferably about 30 degrees). Each planar side has a recess 42 extending parallel to the planar back surface 34. Each recess houses a hole 44. When tag 16 is placed in the base frame member 12, holes 44 of the tag align with holes 30 of the base frame. This preferred embodiment, as shown in FIG. 2, utilizes the threaded members 23 through holes 44, and holes 30 into nuts 31 to secure tag 16 to device 10. Threaded members 23 can also be used to secure tag 10 and/or base frame member 12 to railroad car 60.

The top frame member 14 is generally U-shaped having two legs 46 and a bight section 48. Both of the legs as well as the bight section have planar front and back surfaces. Top frame member 14 has a planar top 49 extending rearwardly from top frame member 14 at approximately 90 degrees. The bight section has a planar bottom consisting of two spaced-apart planar sections 50 extending outwardly approximately 90 degrees with respect to bight section 48. The open space between planar sections 50 accommodates easy scanning of the tag 16 from above. The planar sections 50 restrain the tag 16 from movement in the upward direction. Each leg 46 has a hole 52. As illustrated in FIG. 2, top frame member 14 cooperates with base frame member 12 so as to align holes 52 with holes 28. This preferred embodiment utilizes threaded members 25 through holes 52 and holes 28 and into nuts 29 to secure top frame member 14 to base frame member 12. Threaded member 25 can also be used to secure top frame member 14 and/or base frame member 12 to the railroad car 60.

In operation, base frame member 12 is secured horizontally to railroad car 60. A preferred embodiment uses threaded members 27 to accomplish this, but alternative embodiments include welding the base frame to the railroad car. Encoded identification tag 16 is then placed horizontally between angular strips 22 and main planar section 18 so that holes 30 align with holes 44. Threaded members 23 placed through holes 44, holes 30 and nuts 31 secure tag 16 to base frame 12. Top frame member 14 is placed horizontally over tag 16 so that leg members 46 are between angular strips 22 and main planar section 18 and holes 52 align with holes 28. Threaded members 25 placed through holes 52, holes 28 and nuts 29 secure top frame member 14 with base frame member 12.

To remove encoded identification tag 16, threaded members 25 are removed from nuts 29, allowing top frame member 14 to be lifted and removed from base frame member 12. Threaded members 23 are then removed from nuts 31 and holes 30 allowing encoded identification tag 16 to be lifted and removed. Base frame member 12 remains secured to railroad car 60.

An alternative embodiment secures base frame 12 to railroad car 60 by welding planar top 33, planar sides 35 and planar bottom 37 to car 60. Cooperation between tag 16, top frame member 14 and base frame member 12 is then identical to the preferred embodiment.

From the foregoing, it will be seen that this invention is one well adapted to attain all the ends and objects hereinabove set forth, together with other advantages which are obvious and which are inherent to the structure.

Threaded members are shown in the preferred embodiment to facilitate cooperation between base frame member 12 and top frame member 14, to secure identification tag 16 to device 10 and to secure the base frame member 12 and device 10 as a whole to the railroad car. These threaded members specifically are intended as an illustration, not as a limitation.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A device for securing an encoded identification tag to an enclosure adapted to be moved from one location to another, the identification tag including a horizontally elongated body having spaced substantially parallel front and back faces, spaced substantially parallel top and bottom edges, and side edges extending obliquely to the front and back faces, such that the tag is substantially trapezoidal in a cross-sectional plane substantially parallel to the edges, said device comprising:

a base frame member adapted to be secured to said enclosure, said base frame member having a substantially planar main section elongated along a longitudinal axis and adapted to be opposed to the back face of the tag, said base frame member being adapted to lie with said main section in a substantially vertical plane with said longitudinal axis substantially horizontal and having first and second longitudinal ends and top and bottom sides;

first and second base sections, each of said base sections being connected to said base frame member in proximity to an associated one of said ends and in proximity to said bottom side, and extending outwardly from said main section to thereby support the tag against downward movement, and said base sections being spaced from each other along said longitudinal axis to define a continuous open area between said base sections for unobstructed visual access to a portion of the bottom edge of the tag, said portion substantially corresponding to a majority of the length of the tag;

a top frame member removably mounted on said base frame member;

first and second top sections, each of said top sections being connected to said top frame member in proximity to an associated one of said ends of said base frame member and in proximity to said top side, and extending outwardly of said main section to thereby support the tag against upward movement, and said top sections being spaced from each other along said longitudinal axis to define a continuous open area between said top sections for unobstructed visual access to a portion of the top edge of the tag, said portion of the top edge substantially corresponding to a majority of the length of the tag; and means mounted on said base frame member, proximate said ends of said base frame member, for supporting the tag against movement in the direction of said longitudinal axis and against movement normal to and outwardly of said main section, said means being spaced along said longitudinal axis to define an open area between said means for unobstructed visual access to at least a majority of the front face of the tag.

2. The device of claim 1, wherein said means comprises at least one strip member connected to said base frame member in proximity to each of said ends, each of said strip members having a first strip end connected to said base frame member and a second free strip end, each respective one of said strip members extending at an angle outwardly from said main section and toward said end of said base frame member with which said respective strip member is not connected proximate.

3. The device of claim 2, wherein said top frame member includes an elongated bight extending substantially parallel to said longitudinal axis and in proximity to said top edge, said first and second top sections being connected to said bight, and further includes first and second legs extending outwardly from respective longitudinal ends of said bight, substantially perpendicular to said longitudinal axis and substantially parallel to said main section, each of said legs being mounted between an associated one of said strip members and said main section of said base frame member.

4. The device of claim 3, wherein said top frame member further includes a top member extending from said bight inwardly of said main section and above said top edge of said base frame member.

5. The device of claim 4, further comprising means for releasably fixing each of said legs to said base frame member.

* * * * *